US012703600B2

(12) United States Patent
Nichols

(10) Patent No.: US 12,703,600 B2
(45) Date of Patent: Aug. 11, 2026

(54) SNAP-TOGETHER REEL WITH REINFORCED TAB

(71) Applicant: Vandor Corporation, Richmond, IN (US)

(72) Inventor: Christopher Nichols, Englewood, OH (US)

(73) Assignee: Vandor Corporation, Richmond, IN (US)

( * ) Notice: Subject to any disclaimer, the term of this patent is extended or adjusted under 35 U.S.C. 154(b) by 21 days.

(21) Appl. No.: 18/680,717

(22) Filed: May 31, 2024

(65) Prior Publication Data

US 2024/0400344 A1 Dec. 5, 2024

Related U.S. Application Data

(60) Provisional application No. 63/506,291, filed on Jun. 5, 2023.

(51) Int. Cl.
*B65H 75/22* (2006.01)
*B65H 75/14* (2006.01)

(52) U.S. Cl.
CPC ..... *B65H 75/2281* (2021.05); *B65H 75/14* (2013.01); *B65H 75/22* (2013.01); *B65H 75/2227* (2021.05); *B65H 75/2245* (2021.05); *B65H 75/2254* (2021.05); *B65H 75/229* (2021.05); *B65H 75/2272* (2021.05); *B65H 2701/5136* (2013.01)

(58) Field of Classification Search
CPC ..... B65H 75/22; B65H 75/2227; B65H 75/2245; B65H 75/2254; B65H 75/2272; B65H 75/2281; B65H 75/229; B65H 75/2218; B65H 75/2236; B65H 75/2263; B65H 75/14; B65H 75/143; B65H 75/145; B65H 2701/513; B65H 2701/5136
USPC ... 242/607, 607.1, 607.2, 608, 608.2, 608.3, 242/608.5, 608.6, 608.7
See application file for complete search history.

(56) References Cited

U.S. PATENT DOCUMENTS 2,575,131 A * 11/1951 Salkin ..... B65H 75/14 242/118.6
3,438,592 A * 4/1969 Posso ..... G03B 21/321 242/608.5

(Continued)

FOREIGN PATENT DOCUMENTS

DE 4414577 A1 * 11/1995 ..... B65H 75/2245
DE 102008019760 A1 * 10/2008 ..... B65H 75/14

(Continued)

*Primary Examiner* — Victoria P Augustine
*Assistant Examiner* — Raveen J Dias
(74) *Attorney, Agent, or Firm* — Maginot, Moore & Beck LLP

(57) ABSTRACT

A reel includes a core having a first end region defining a plurality of slots, a first flange, and a plurality of latching arrangements configured to, in a connected state, connect the first end region of the core to the first flange. Each respective latching arrangement includes a latch arm having a latching projection that, in the connected state, is arranged in an associated slot of the plurality of slots, and a support member that, in the connected state, supports the latch arm on a side of the latch arm opposite the latching projection so as to disable the latching projection from moving out of the associated slot.

17 Claims, 9 Drawing Sheets

(56) References Cited

U.S. PATENT DOCUMENTS 3,552,677 A * 1/1971 Hacker ..... B65H 75/14 242/118.61
3,785,584 A * 1/1974 Crellin, Jr. ..... B65H 75/14 403/381
4,101,095 A * 7/1978 Carter ..... B65H 75/2281 242/608.5
5,335,873 A * 8/1994 Harris ..... B65H 16/005 242/348
5,464,171 A * 11/1995 Ripplinger ..... B29C 66/12821 242/118.61
5,531,399 A * 7/1996 Weisburn ..... G11B 23/037 242/608.6
5,575,437 A * 11/1996 Campbell ..... B65H 75/22 242/608.6
5,676,332 A * 10/1997 Kraus ..... B65H 75/2281 242/608.6
5,727,752 A * 3/1998 Matsuzoe ..... B65H 75/2281 242/608.6
5,775,634 A * 7/1998 Fettes ..... G03B 21/321 242/608.6
5,803,401 A * 9/1998 Matsuzoe ..... B65H 75/2245 242/608.5
6,045,087 A * 4/2000 Vislocky ..... B65H 75/14 242/608.2
6,398,154 B1 * 6/2002 Cox ..... B65H 75/14 242/608.2
6,425,550 B1 * 7/2002 Gayowski ..... G11B 23/037 242/608.5
6,588,697 B2 * 7/2003 Kitayama ..... B65H 75/2245 242/610.6
6,857,595 B1 * 2/2005 Schaefer ..... B65H 75/2272 242/608.5
7,108,222 B1 * 9/2006 Schaefer ..... G11B 23/044 242/608.6
8,424,796 B2 * 4/2013 Witwer ..... B65H 75/2281 242/118.6
9,637,346 B2 * 5/2017 Connell ..... B65H 75/145
11,697,569 B2 * 7/2023 Fratianni ..... B65H 75/2272 242/608.6
2002/0017588 A1 * 2/2002 Kitayama ..... B65H 75/2281 242/608.6
2004/0173713 A1 * 9/2004 Lorenzo Barroso ..... B65H 75/2218 242/608.5
2007/0181739 A1 * 8/2007 Derendal ..... B65H 75/2245 242/608.5
2009/0314876 A1 * 12/2009 Kessler ..... B65H 75/14 264/277
2010/0025521 A1 * 2/2010 Snitselaar ..... B65H 75/2245 242/608.2
2011/0253830 A1 * 10/2011 Witwer ..... B65H 75/2218 242/608.6
2014/0312159 A1 * 10/2014 Troitzsch ..... B65H 75/2281 242/608.2
2015/0329311 A1 * 11/2015 Connell ..... B65H 75/14 242/118.61
2016/0355371 A1 * 12/2016 Baranov ..... B65H 75/2272
2022/0098002 A1 * 3/2022 Kisselstein ..... B65H 75/2245
2022/0281710 A1 * 9/2022 Fratianni ..... B65H 75/22
2023/0286776 A1 * 9/2023 Fratianni ..... B65H 75/2272
2024/0359944 A1 * 10/2024 Nichols ..... B65H 75/2272
2024/0391180 A1 * 11/2024 Elder ..... B65H 75/14
2024/0400343 A1 * 12/2024 Nichols ..... B65H 75/14
2024/0400345 A1 * 12/2024 Brown ..... B65H 75/2218
2024/0417210 A1 * 12/2024 Brown ..... B29C 66/522

FOREIGN PATENT DOCUMENTS

DE 102011121986 B3 * 2/2013 ..... B65H 75/2227
DE 202021104413 U1 * 8/2021 ..... B65H 75/241
EP 1975107 B1 * 10/2011 ..... B65H 75/2245
FR 2691448 A1 * 11/1993 ..... B65H 75/2236
GB 1479529 A * 7/1977 ..... B65H 75/14
GB 2493518 A * 2/2013 ..... B65H 75/2254
JP 2000118877 A * 4/2000 ..... B65H 75/22
KR 200486361 Y1 * 5/2018 ..... B65H 75/22
WO WO-9509800 A1 * 4/1995 ..... B65H 75/2245
WO WO-9819953 A1 * 5/1998 ..... B65H 75/2281
WO WO-0208107 A1 * 1/2002 ..... B65H 75/2218
WO WO-0247875 A2 * 6/2002 ..... B65H 75/2245
WO WO-2004014772 A1 * 2/2004 ..... B65H 75/2281
WO WO-2023003615 A1 * 1/2023 ..... B65H 75/2245

* cited by examiner

SNAP-TOGETHER REEL WITH REINFORCED TAB

CROSS-REFERENCE TO RELATED APPLICATION

This application claims priority to U.S. Provisional Application Ser. No. 63/506,291 entitled "Snap-Together Reel with Reinforced Tab" filed Jun. 5, 2023, the disclosure of which is incorporated herein by reference in its entirety.

FIELD

This disclosure relates generally to apparatus for supporting wound flexible media, for example, cord, cable, fiber or wire.

BACKGROUND

The transport and use of cable, wire, optical fiber, and other wound media typically involves winding the flexible media on a spool or reel. Typical reels for construction purposes can have a traverse length (or axial height) of any length, and any flange diameter. Reels generally consist of a core around which the wound media is wrapped, and two flanges at opposite ends of the core. Such reels can be made of wood, but are often constructed of plastic and/or corrugated paper to obtain better strength-to-weight ratios. Reels further more often include steel bolts, staples, or other connectors. Such reels have many good features, but can present difficulties in recycling due to the use of different materials. Recycling used reels is a feature that can lead to reduced landfills, and overall environmental improvements.

There is a need, therefore, for a reel design that facilitates recycling while maintaining sufficient structural integrity for normal use.

SUMMARY

In one embodiment, a reel includes a core having a first end region defining a plurality of slots, a first flange, and a plurality of latching arrangements configured to, in a connected state, connect the first end region of the core to the first flange. Each respective latching arrangement includes a latch arm having a latching projection that, in the connected state, is arranged in an associated slot of the plurality of slots, and a support member that, in the connected state, supports the latch arm on a side of the latch arm opposite the latching projection so as to disable the latching projection from moving out of the associated slot.

In another embodiment, a method of assembling a reel includes inserting a first end region of a core, which defines a plurality of slots, into a channel of a first flange. The method further includes connecting the first end region of the core to the first flange with a plurality of latching arrangements by arranging a latching projection of a latch arm of each of the plurality of latching arrangements in an associated slot of the plurality of slots and supporting the latch arm of each of the plurality of latching arrangements on a side of the latch arm opposite the latching projection with a support member so as to disable the latching member from moving out of the associated slot.

DETAILED DESCRIPTION

For the purposes of promoting an understanding of the principles of the embodiments described herein, reference is now made to the drawings and descriptions in the following written specification. No limitation to the scope of the subject matter is intended by the references. This disclosure also includes any alterations and modifications to the illustrated embodiments and includes further applications of the principles of the described embodiments as would normally occur to one skilled in the art to which this document pertains.

Figure 1:
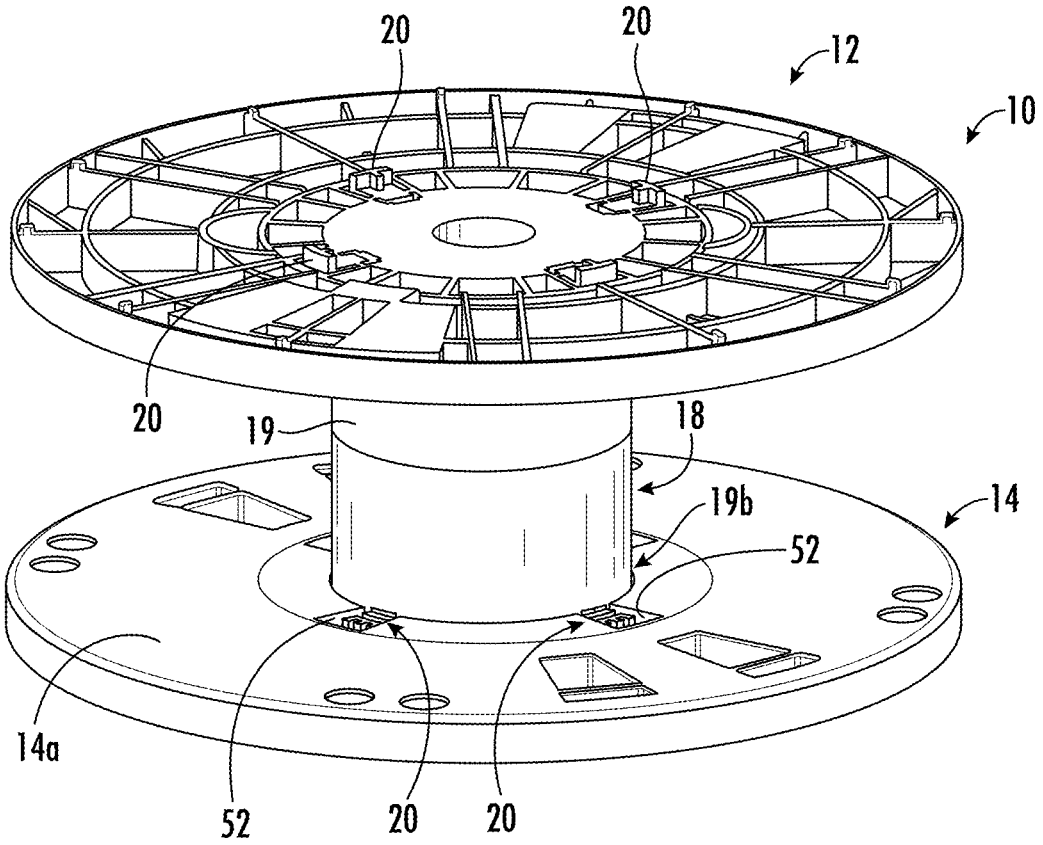
FIG. 1 is a perspective view of an exemplary embodiment of a reel according to the disclosure.
Figure 2:
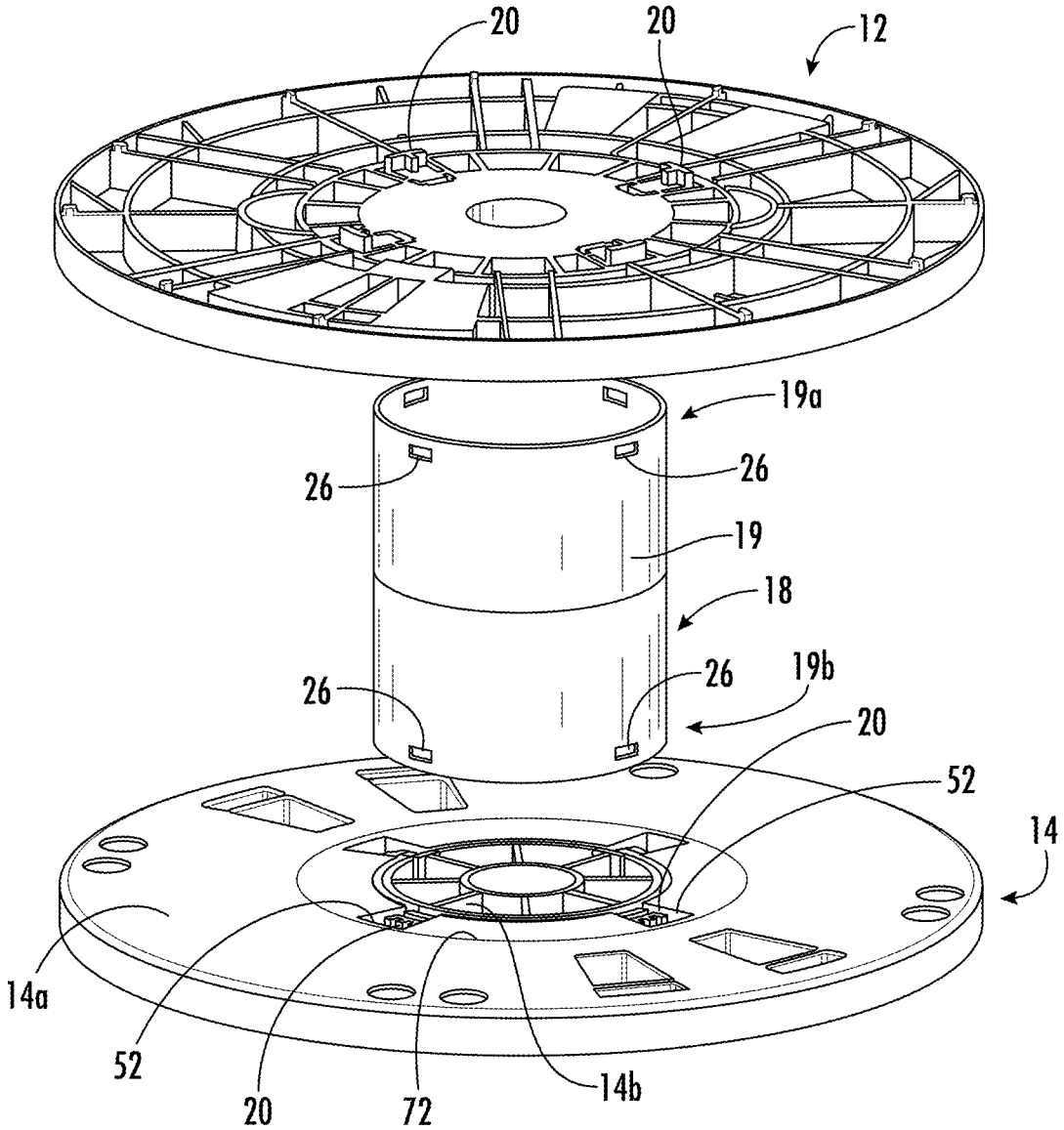
FIG. 2 is an exploded perspective view of the reel of FIG. 1.

FIG. 1 shows a perspective view of an exemplary embodiment of a reel 10 according to the disclosure, and FIG. 2 shows an exploded perspective view of the reel 10 of FIG. 1. With reference to FIGS. 1 and 2, the reel 10 includes a first flange 12, a second flange 14, a core 18, and a plurality of latching arrangements 20. In one embodiment, all of the elements 12, 14, 18 and 20 are formed of plastic.

Flexible media, not shown, but which can include cable, wire, fiber optical cable, rope, string, etc., can be wound around the core 18 and axially retained on the core by the flanges 12, 14. As will be discussed in further detail below, each of the latching arrangements 20 has features that interact with corresponding features on the respective flange 12, 14 and corresponding features of the core 18 in a locked configuration to securely connect the flanges 12, 14 to the core 18.

The core 18 is formed as a hollow, preferably cylindrical, body 19 having a first end region 19*a* connected to the first flange 12 and a second end region 19*b* connected to the second flange 14. Each of the first and second end regions 19*a*, 19*b* includes a plurality of windows or slots 26 that are defined entirely through the thickness of the hollow body 19. More specifically, each of the slots 26 extends through the hollow body 19 and is disposed proximate the respective axial end region 19*a*, 19*b* of the core 18, but is spaced apart from the end surface.

In the illustrated embodiment, the flanges 12, 14 and the latching arrangements 20 are substantially identical at each end of the core 18. The following description therefore only describes the connection between the second end region 19*b* of the core 18, the flange 14, and the latching arrangements 20 at the second end region 19*b* side, though the reader should appreciate that the flange 12 is connected to the opposite end region 19*a* of the core 18 in substantially the same manner. However, in some embodiments, the locking arrangement described herein may be present at only one end of the core 18, and the opposite end may be connected by another desired connection arrangement.

Each of the flanges 12, 14 is shaped generally in the form of a disk that includes various ribs and features as shown, and includes a core nest or channel 72 configured to receive the axial end regions 19*a*, 19*b* of the core 18. When assembled, the core 18 is disposed between and connected to the first flange 12 and the second flange 14 as shown in FIG. 1. The latching arrangements 20 are configured to engage the slots 26 to secure the first flange 12 to the first axial end region 19*a* of the core body 19, and to secure the second flange 14 to the second axial end region 19*b* of the core body 19.

Figure 3:
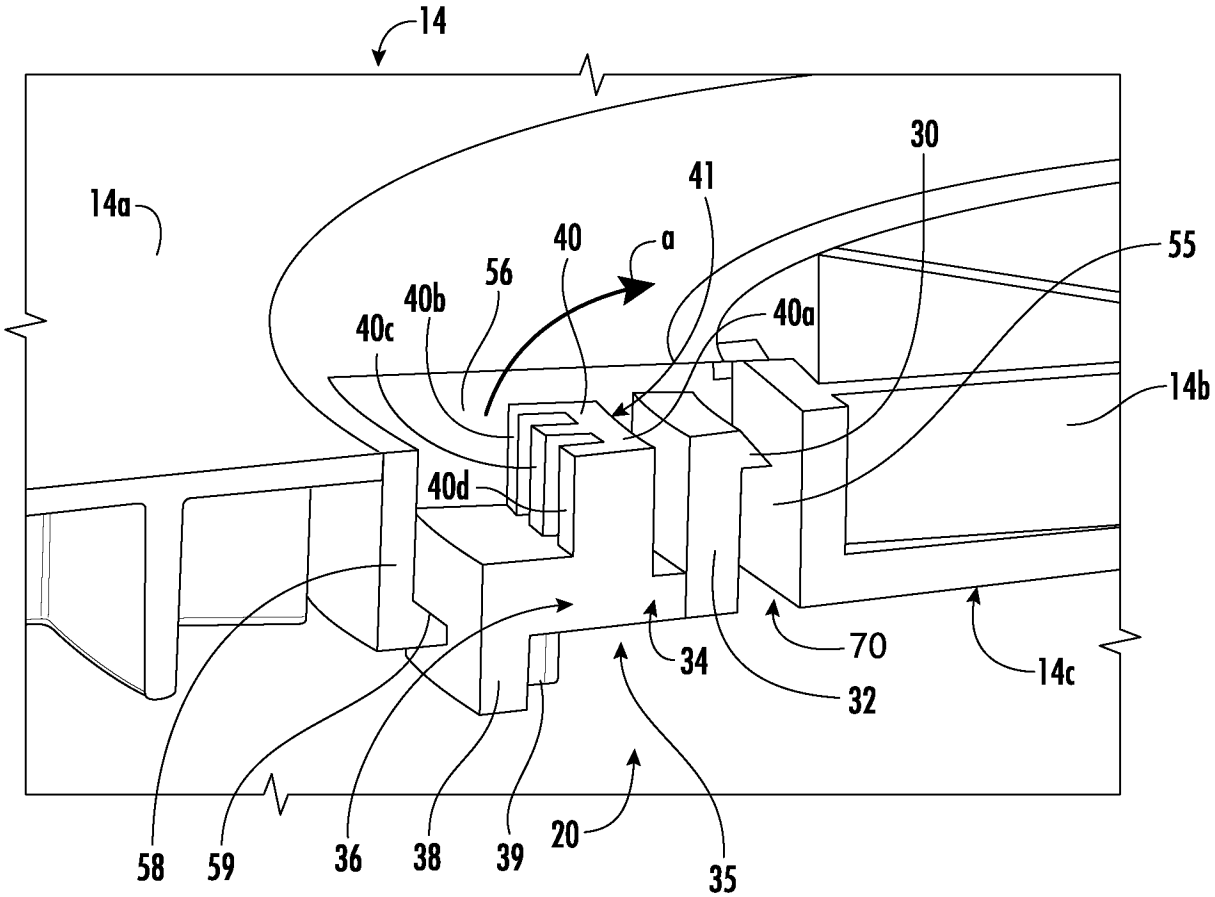
FIG. 3 is a fragmentary, cutaway, perspective view of one of the latching arrangements of the reel of FIG. 1 in context with the flange.
Figure 4:
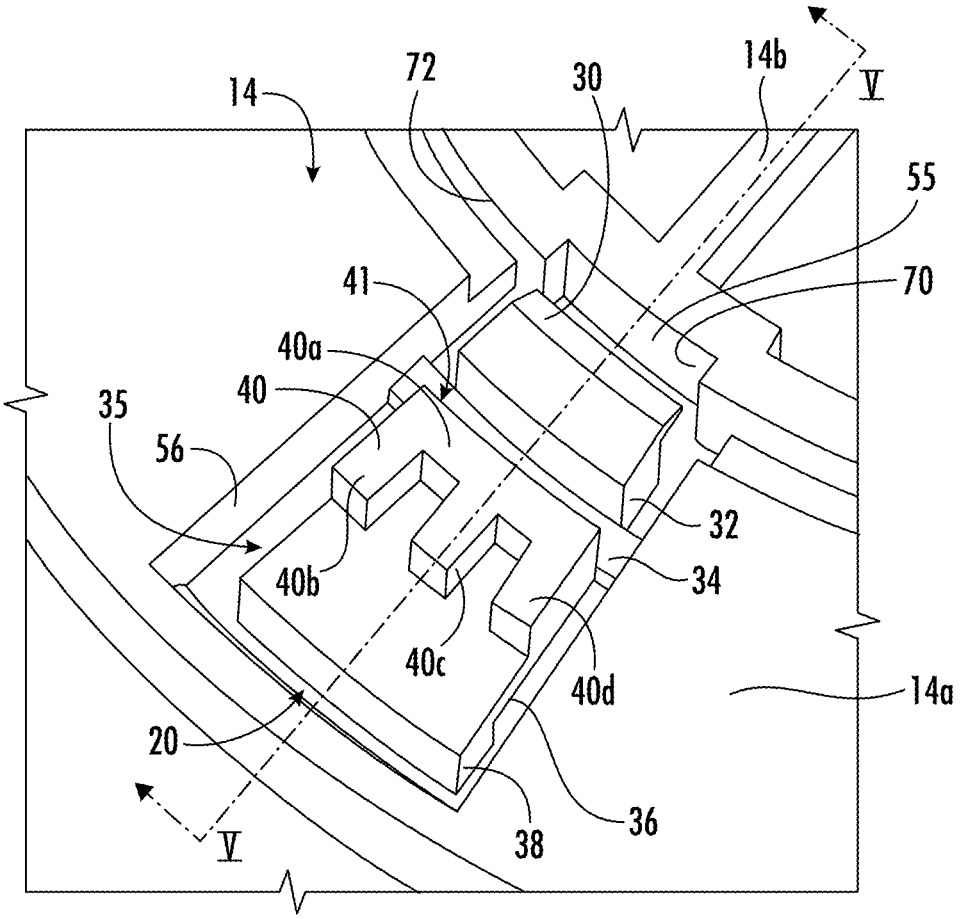
FIG. 4 is a fragmentary perspective view of the latching arrangement of the reel of FIG. 1 in context with the flange.

FIG. 3 shows a fragmentary, cutaway, perspective view of one of the latching arrangements 20 in context with the flange 14. FIG. 4 shows a fragmentary perspective view of the latching arrangement 20 also in context with the flange 14. FIGS. 3 and 4 show the latching arrangement 20 and flange 14 as they are molded or otherwise integrally formed according to first embodiment. The latching arrangement 20 in FIGS. 3 and 4 is shown in the unactivated state. As will be discussed below in connection with FIG. 5, the latching arrangement 20 is transitioned to the activated state preferably prior to connection of the flange 14 to the core 18.

In the illustrated embodiment, the latching arrangement 20 is disposed in a cavity 52 of the inner surface 14*a* of the flange 14. The inner surface 14*a* is a flat surface in the form of an annulus which faces toward the opposite flange 12 and contacts the wound media to be retained, not shown, on the finished reel 10. As shown in FIG. 1, the cavity 52 is disposed radially adjacent to the second end region 19*b* at which the core 18 engages the flange 14, or in other words, the core receiving channel 72. The flange 14 also includes various structures in the hub/core area, such as the rib 14*b* shown in FIGS. 3 and 4, which supports a radially inner wall 55 of the cavity 52.

The latching arrangement 20 includes a latch arm 32 having a latching projection 30 that projects toward the radially inner wall 55, a connecting bar 34, and a support member 35. The connecting bar 34 extends radially inwardly from the support member 35 and is connected to radially extending side walls 56 of the cavity 52 such that the latching arrangement 20 is coupled to the side walls 56 of the cavity 52.

The support member 35 has a main body 36, an axial extension 38, and a reinforcement projection 40. The axial extension 38 extends from the main body 36 in a direction toward the outer side 14*c* of the flange 14. The reinforcement projection 40 extends from the main body 36 in a direction toward the inner side 14*a* of the flange 14 and includes a circumferentially extending main portion 40*a* and a plurality of radially-extending reinforcing portions, of which there are three reinforcing portions 40*b*, 40*c*, 40*d* in the illustrated embodiment. The main portion 40*a* defines a reinforcement wall 41, which faces in a direction toward the latch arm 32. In the embodiment of FIGS. 1-5, support member 35 also includes bottom rib 39 extending downward from a bottom surface of the main body 36, and extending radially inwardly from the axial extension 38.

As shown in FIG. 4, in the latching arrangement 20, and more specifically the connecting bar 34, is coupled to the side walls 56 of the cavity 52. The support member 35 is cantilevered from the connecting bar 34 within the cavity 52. At the end of the cavity 52 opposite the inner wall 55, the flange 14 includes a radially outer wall 58, which has a stop configured as a chamfered ledge 59 that projects from the inner wall 55 in a direction toward the support member 35 and is oriented with the angled surface of the chamfer directed generally radially inwardly and axially toward the inner surface 14*a*.

Figure 5:
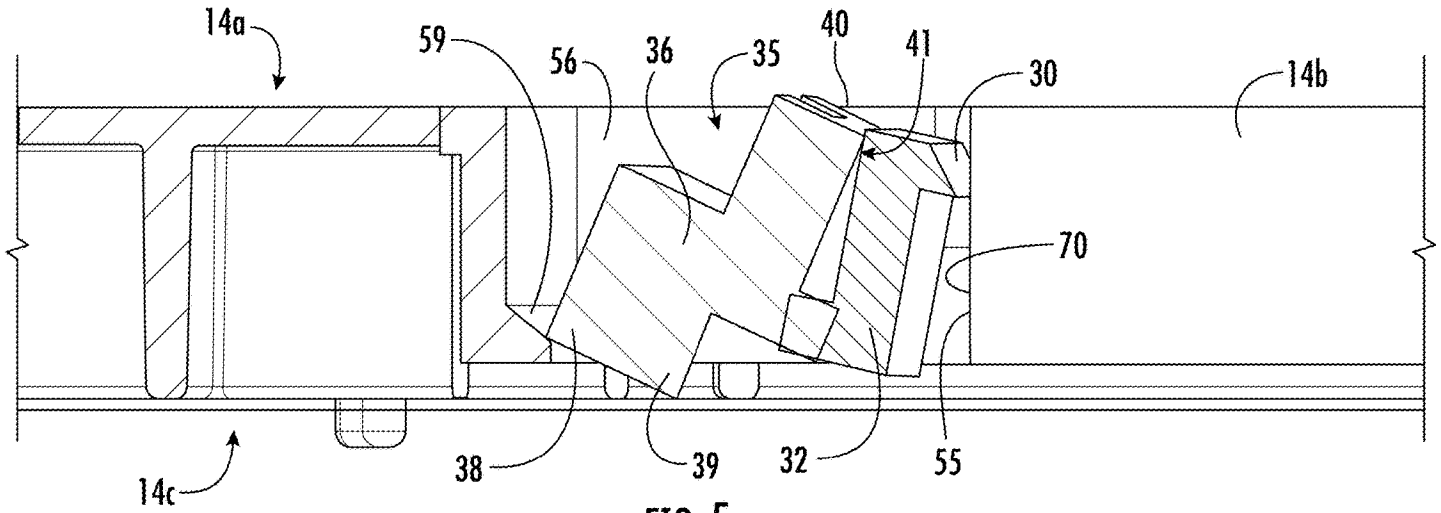
FIG. 5 is a fragmentary side cutaway view of the latching arrangement of the reel of FIG. 1 in the activated state.

FIG. 5 shows a fragmentary side cutaway view of the latching arrangement 20 in the activated state. The latching arrangement 20 is shown FIG. 5 orthogonally cut through the center in a radial plane along the line V-V shown in FIG. 4. To transition the latching arrangement 20 from the unactivated state of FIGS. 3 and 4 to the activated state of FIG. 5, upward force (from the perspective of FIGS. 3, 4, and 5) is applied on the bottom of the support member 35, for example on the axial extension 38 and/or the bottom rib 39, though the upward force may be applied to any suitable position that is radially outward of the connecting bar 34.

The upward force causes the support member 35 to rotate clockwise (as seen in the views of FIGS. 3 and 5) approximately about the connecting bar 34, indicated by rotation direction a. The reinforcement wall 41 of the reinforcement projection 40 then engages the latch arm 32 and causes the latch arm 32 to rotate toward the inner wall 55, also about the connecting bar 34. When the bottom of the axial extension 38 clears the chamfered ledge 59, the upward force applied to the connecting bar 38 is released, and at least a portion of the bottom of the connecting bar 38 is seated on the chamfered ledge 59 to hold the support member 35 and the latch arm 32 in the activated position shown in FIG. 5. In the activated position, the latching projection 30 of the latch arm 32 is firmly disposed within the core receiving channel 70, 72 in the flange 14.

Figure 5A:
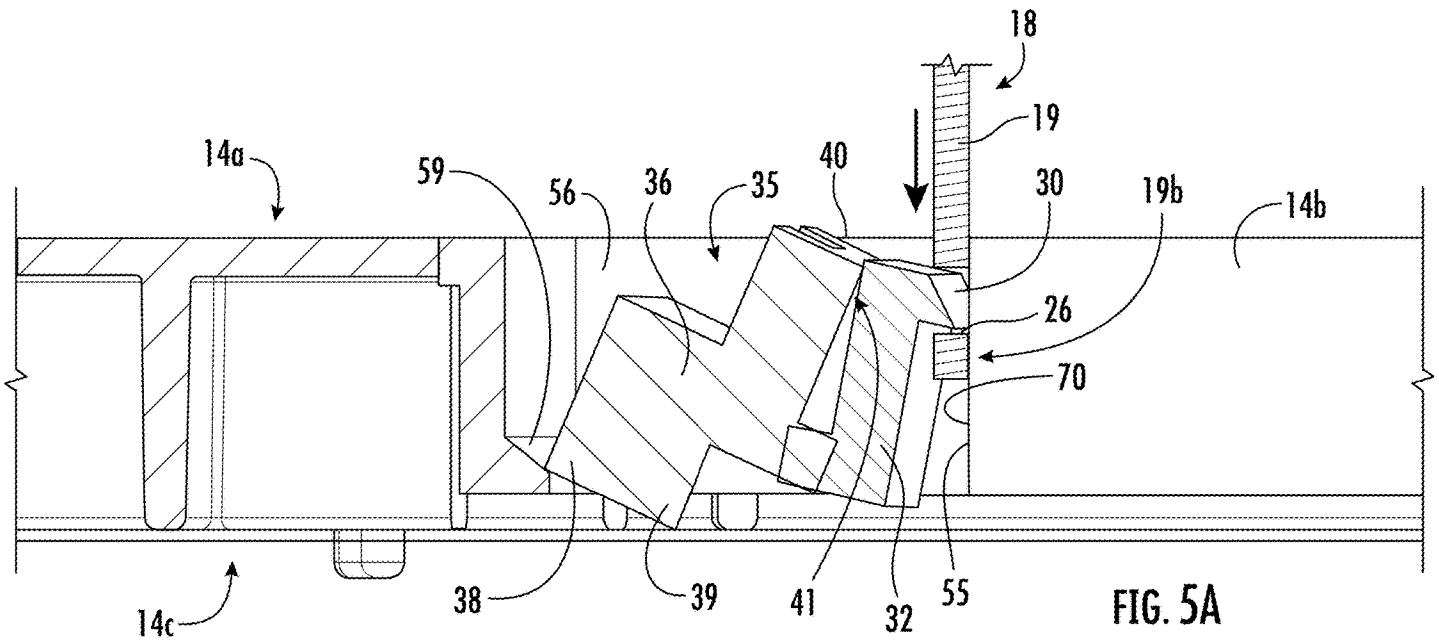
FIG. 5A is a fragmentary side cutaway view of the latching arrangement of the reel of FIG. 1 with the core inserted into the annular channel.

In a next step, the slots 26 defined in the hollow body 19 of the core 18 are aligned with the portions 70 of the channel 72 in which the latching projections 30 of the latching arrangements 20 are located, as shown in FIG. 2. The hollow body 19 is then inserted into the channel 72, with force sufficient to push the inclined surface of the latching projection 30. The latching projection 30 elastically yields to the second end region 19*b* of the core body 19 as it is inserted, and then releases back into the slot 26, thereby securing the core 18 to the flange 14 as shown in FIG. 5A. The tension of the stressed latching arrangement 20, including the tension from the elastic deformation of the latch arm 32 and the tension from the elastic deformation of the support member 35, which acts via the reinforcement wall 41 on the surface of the latch arm opposite the latching projection 30, strengthens the connection between the core 18 and flange 14. The other flange 12 may be assembled in the same manner.

Figure 6:
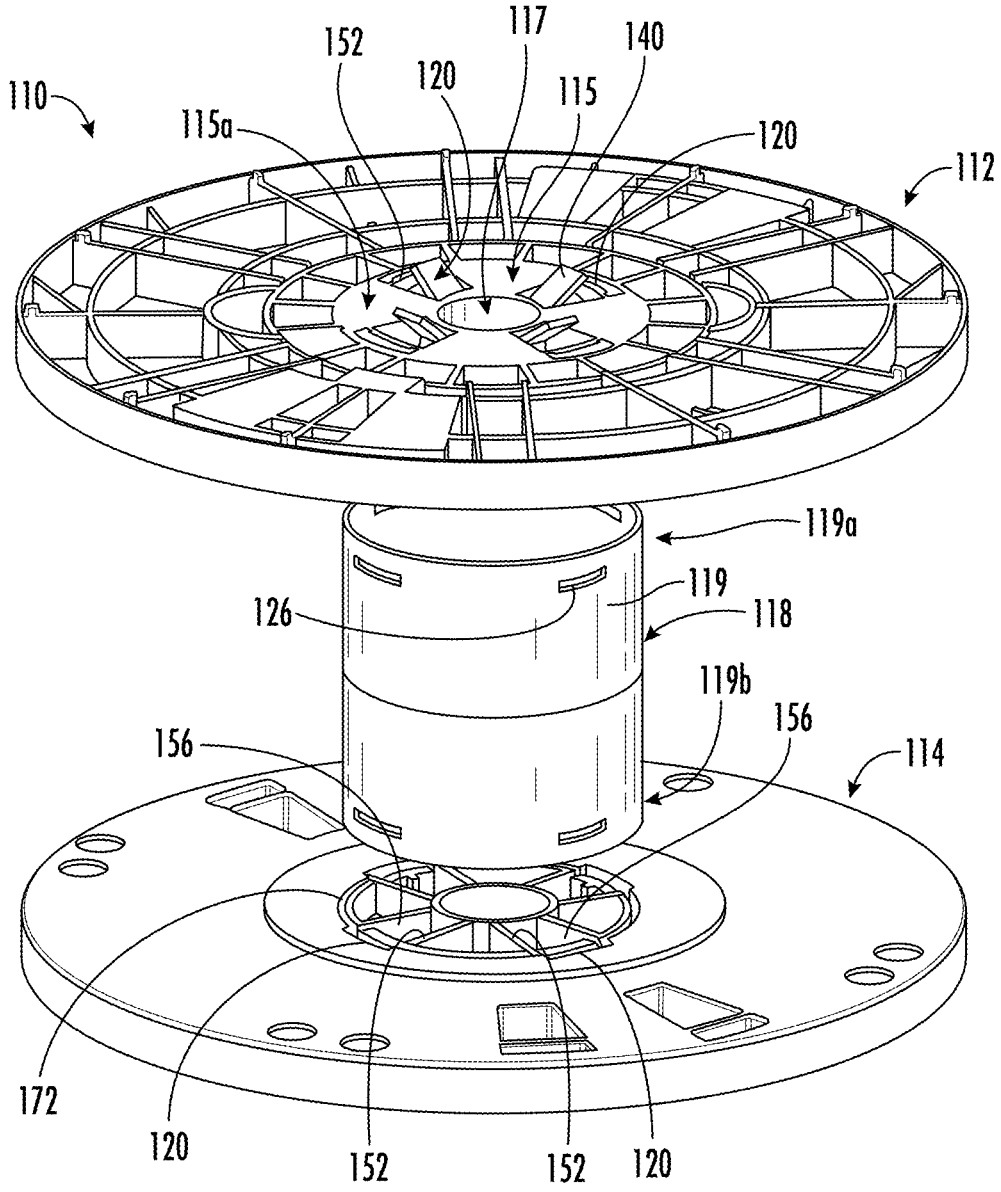
FIG. 6 is an exploded perspective view of another reel according to the disclosure.
Figure 7:
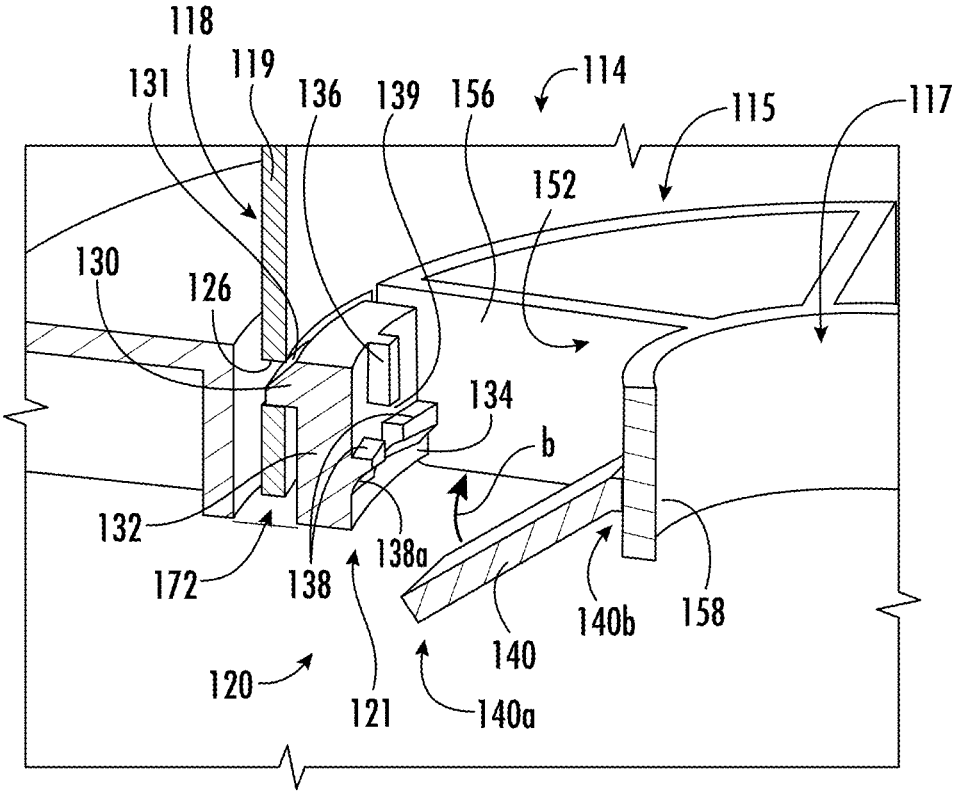
FIG. 7 is a fragmentary, cutaway, perspective view of one of the latching arrangements of the reel of FIG. 6 in context with the flange.
Figure 8:
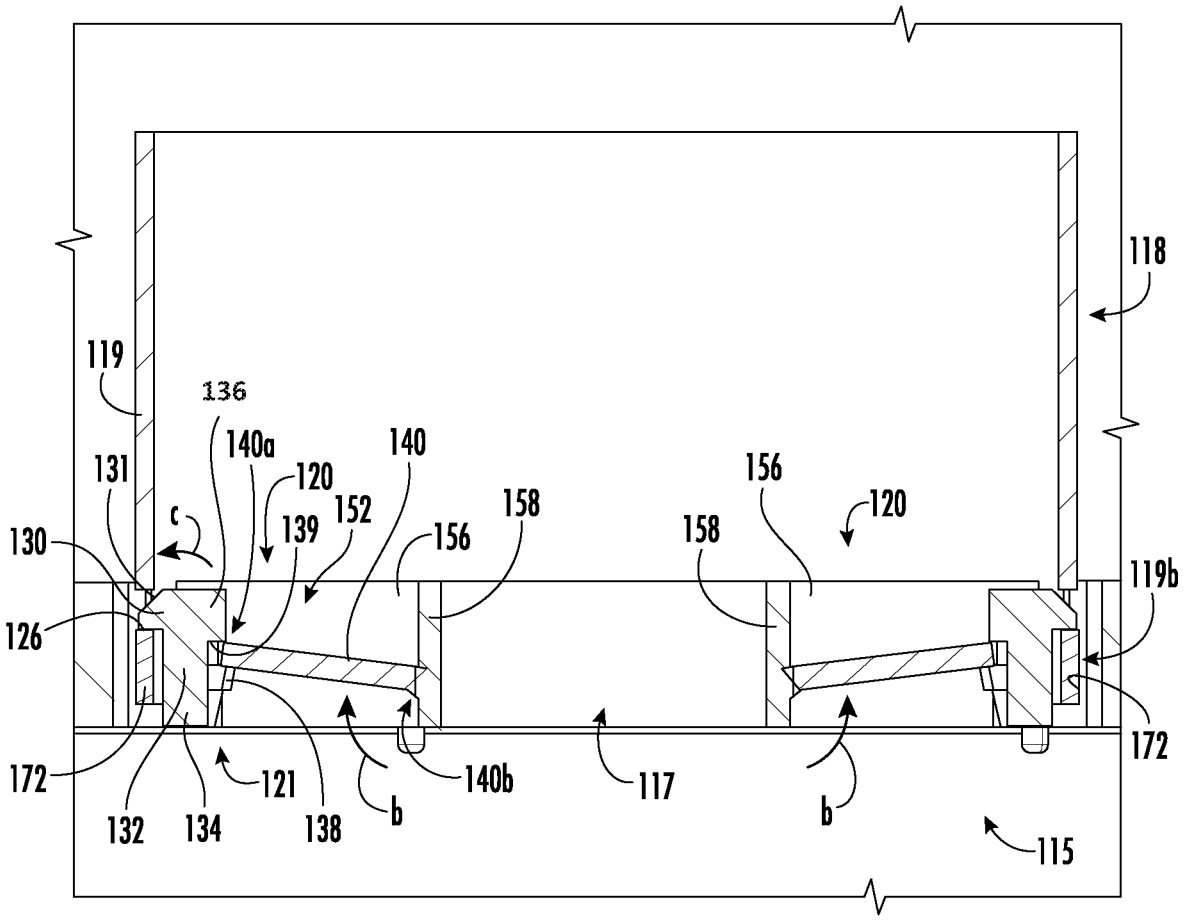
FIG. 8 is a cross-sectional view of the latching arrangement of the reel of FIG. 6 in the connected state.

A second embodiment of a reel 110 is shown in FIGS. 6, 7, and 8. In the second embodiment, the latching arrangements further include reinforcing structures. In particular, FIG. 6 shows an exploded, perspective view of an exemplary embodiment of an alternative reel 110 according to the disclosure. The reel 110 includes a first flange 112, a second flange 114, a core 118, and a plurality of latching arrangements 120. In one embodiment, all of the elements 112, 114, 118 and 120 are formed of plastic. The core 118, like the core 18 of FIGS. 1 and 2, is formed of a hollow, preferably cylindrical, body 119 that includes a plurality of slots 126 proximate to each axial end region 119*a*, 119*b*. Each of the flanges 112, 114 is generally in the form of a disk that includes various ribs and features as shown, and includes a core nest or channel 172 configured to receive the axial ends of the core 118. When assembled, the core 118 is disposed between and connected to the first flange 112 and the second flange 114, similar to the reel 10 of FIGS. 1 and 2. The latching arrangements 120 are configured to engage the slots 126 to secure the first flange 112 to a first axial end region 119*a* of the core 118, and to secure the second flange 114 to the second axial end region 119*b* of the core 118.

Flexible media, not shown, but which can include cable, wire, fiber optical cable, rope, string, etc., can be wound around the core 118 and axially retained on the core by the flanges 112, 114. The latching arrangement 120 has features that cooperate with features on each of the flanges 112, 114 and the core 118 that assist in retaining the corresponding flanges 112, 114 on or to the core 118. In this embodiment, a plurality of the latching arrangements 120 secure the flange 112 to the first end region 119*a* of the hollow body 119 of the core 118, and another plurality of the latching arrangements 120 secure the flange 114 to the second end region 119*b* of the hollow body 119 of the core 118.

FIG. 7 shows a fragmentary, cutaway, perspective view of one of the latching arrangements 120 in context with the flange 114. FIG. 7 shows the latching arrangement 120 and flange 114 as they are molded or otherwise integrally formed according to the present embodiment. The latching arrangement 120 in FIG. 7 is shown in the unactivated state. As will be discussed below in connection with FIG. 8, the latching arrangement 120 is transitioned to the activated state preferably after connection of the flange 114 to the core 118.

In the embodiment of FIGS. 6-8, the latching arrangement 120 is disposed in a cavity 152 of the outer surface 115*a* the hub area 115 of the flange 114. The outer surface 115*a* is a flat surface in the form of an annulus that extends between the central opening 117, in which an axle may be inserted for rotation of the reel, and the core channel 172. As shown in FIG. 6, the cavity 152 is disposed radially adjacent to where the second end region 119*b* of the core body 119 engages the flange 114 (i.e. adjacent the core channel 172).

As is best seen in FIGS. 7 and 8, the latching arrangement 120 includes a latch arm 132 having a latching projection 130, a top stop 136, and at least one bottom stop 138. The latching arrangement 120 further includes a connecting bar 134 and a support member 140. As shown in FIG. 7, the main latch 121, comprising the latch arm 132 and the connecting bar 134, is disposed adjacent to the core channel 172. The connecting bar 134 extends circumferentially outwardly from the latch arm 132 and is coupled to the radially-extending side walls 156 of the cavity 152 so as to connect the latch arm 132 to the side walls 156.

The latching projection 130 is arranged at the distal end region of the latch arm 132, opposite the connecting bar 134, and extends from a radially outer side of the latch arm 132 opposite the support member 140. The stops 136, 138 extend radially inwardly from the radially inner side of the latch arm 132, toward the support member 140. The stops 136, 138 define a pocket 139 therebetween for receiving the distal end 140*a* of the support member 140.

The support member 140 is coupled to and extends from a radially inner wall 158 of the cavity 152, which, in particular, defines the central opening 117 of the flange 114. In one embodiment, the support member 140 is molded to the radially inner wall 158, but is still elastically pivotable and deformable about its proximal end 140*b* to angular positions and/or shapes other than that shown in FIG. 7. In particular, the support member 140 is formed as a lever latch that is pivotable from a first position shown in FIG. 7, in which the distal end 140*a* is spaced apart form the latch arm 132, to a second position shown in FIG. 8, in which the distal end 140*a* of the support member 140 is in supporting contact with the latch arm 132 and is arranged in the pocket 139.

In at least some embodiments, the flanges 112, 114 are molded with the latching arrangements 120 formed integrally therewith, in the unactivated state. In the construction of the reel 110, the axial end region 119*b* of the hollow body 119 of the core 118 is inserted into the channel 172 prior to activation of the latching arrangement 120. A beveled top edge 131 of the latching projection 130 redirects the axial insertion force of the core 118 into radial forces acting radially outwardly on the axial end region 119*b* and radially inwardly on the latch arm 132. As a result, the distal end of the latch arm 132 deforms radially inwardly while the core deflects radially outwardly to allow for the axial end region 119*b* to clear the latching projection 130, and seat into the channel 172.

The latching projection 130 then snaps back into the slot 126 to form a semi-locked state in which the latch arm 132 connects the flange 114 to the core 118. However, in the semi-locked state, the latch arm 132 is unsupported on its radially inner side, and the latch arm 132 is therefore still deformable radially inwardly. This state, with the core 118 inserted, but prior to activation of the latching arrangement 120, is shown in FIG. 7.

FIG. 8 shows a fragmentary side cutaway view of the flange 114 attached to the core 118 wherein two latching arrangements 120 are in the activated state. In the activated state, the support member 140 provides reinforcement of the connection between the latching projection 130 and the edges of the slots 126 in the core 118. To transition the latching arrangement 120 from the unactivated state of FIG. 7 to the activated state of FIG. 8, upward force (from the perspective of FIG. 7) may be applied on the bottom of the support member 140 at or near the end opposite the end connected to the wall 158. The upward force may be applied at any suitable position that causes all or part of the support member 140 to rotate about its proximal end 140*b* in the rotational direction b due to elastic deformation.

The upward force causes the distal end 140*a* of the support member 140 to engage the beveled edges 138*a* of the lower stops 138. Continued upward force causes the support member 140 to elastically and, in some embodiments, plastically deform or bend, to reduce its overall length until the support member 140 clears the lower stops 138 and at least partially releases into the pocket 139. In the locked position, shown in FIG. 8, the support member 140 provides reinforcement that disables elastic deformation of the latching projection 130 out of the slot 126 by urging the latching projection 130 and latch arm 132 in the rotational direction c.

Figure 9:
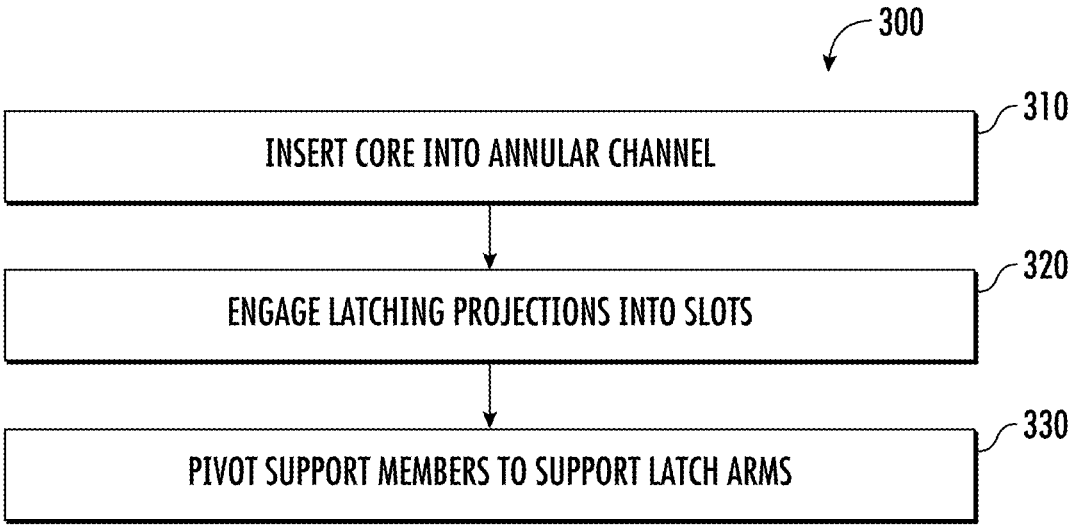
FIG. 9 depicts a process diagram of a method of assembling a reel according to the disclosure.

FIG. 9 depicts a process diagram of a process 300 of assembling a reel such as the reels 10, 110 described above. The process 300 includes inserting the core 10, 110 into the channel 72, 172 of the flange 12, 14, 112, 114 (block 310). The process 300 further includes engaging the latching projection 30, 130 of the latching arrangements 20, 120 into the slots 26, 126 of the core 18 (block 320). In particular, the insertion of the core 18, 118 into the channel 72, 172 causes the latching projections 30, 130 and the latch arms 32, 132 to elastically deform out of the path of the core 18, 118 until the latching projections 30, 130 snap into an associated one of the slots 26, 126.

The process 300 also includes pivoting the support members 40, 140 so as to support the latch arms 32, 132 and disable the latch arms 32, 132 from moving such that the latching projections 30, 130 move out of the associated slot 26, 126 (block 330). The pivoting of the support members may include, for example, pivoting the support member 40 about the connecting bar 34 such that the reinforcing wall 41 engages the side of the latch arm 32 opposite the latching projection 30 as described with reference to FIGS. 1-5A, or pivoting the support member 140 about its proximal end 140*b* such that its distal end 140*a* engages and supports the opposite side of the latching projection 130 as described above with reference to FIGS. 6-8.

The reader should appreciate that the steps 310, 320, 330 of the process 300 may be performed in a different order than that illustrated in FIG. 9. For instance, as noted above, in some embodiments, the support members 40, 140 are pivoted (block 330) into the activated state in which they contact the latch arms 32, 132 to activate the latching arrangements 30, 130 prior to insertion of the core 18, 118 into the annular channel 72, 172 of the flange 12, 14, 112, 114. The core 18, 118 is then inserted into the activated latching arrangement 20, 120 in the annular channel 72, 172 of the flange 12, 14, 112, 114 (block 310).

With respect to the above-referenced embodiments, it be appreciated that the latching arrangements 20, 120 could be activated soon after removal from a molding press. The flanges 12, 14, 112, 114 could then be stacked and stored in a warehouse for either pre-delivery assembly, or the flanges 12, 14, 112, 114 could be sent out to customers in the unassembled state as a kit, which significantly reduces the shipping volume and therefore the shipping costs. The customer could then easily assemble the reels 10, 110 in-house simply by inserting the core 18, 118 into the flanges 12, 14, 112, 114 and applying the associated force to the latching arrangements 20, 120.

Further, it will be appreciated that activation of the latching arrangements 20, 120 can allow for more pliability because the flange 12, 14, 112, 114 is at higher temperature just coming out of the press, substantially higher than room temperature, and less likely to fracture or damage the tabs. In such cases, it is preferable that the flange tabs 20, 120 be activated within 15 minutes of coming out of the press.

In one embodiment, the latching arrangements 20, 120 are formed integrally with the associated flange 12, 14, 112, 114. In one particular embodiment, the latching arrangements 20, 120 may be formed of the same material as the flange 12, 14, 112, 114, for example during the same injection molding process as the flange 12, 14, 112, 114. In another embodiment, the latching arrangements 20, 120 may be formed integrally with the flange 12, 14, 112, 114 of a different material than the flange 12, 14, 112, 114, for example in a second shot of a two-shot injection molding process during production of the flange 12, 14, 112, 114.

It will be appreciated that variants of the above-described and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the foregoing disclosure.

What is claimed is:

1. A reel comprising:

a core having a first end region defining a plurality of slots defined through the core;

a first flange;

a plurality of latching arrangements configured to, in a connected state, connect the first end region of the core to the first flange, each respective latching arrangement of the plurality of latching arrangements comprising:

a latch arm having a latching projection that, in the connected state, is arranged in an associated slot of the plurality of slots; and a support member that, in the connected state, supports the latch arm on a side of the latch arm opposite the latching projection so as to disable the latching projection from moving out of the associated slot, the support member pivotable from a first position to a second position, wherein in the second position the support member applies greater force to the side of the latch arm opposite the latching projection than in the first position.

2. The reel of claim 1, wherein, in the connected state, each respective latching arrangement is arranged in a cavity defined in the first flange.

3. The reel of claim 1, wherein each latch arm is pivotable relative to the first flange from a disconnected state, in which the latching projection is arranged outside the associated slot, to the connected state, in which the latching projection is arranged in the associated slot.

4. The reel of claim 1, wherein the support member and the latch arm of each latching arrangement pivot about a common connecting structure that connects the respective latching arrangement to the first flange.

5. The reel of claim 4, wherein each common connecting structure comprises a connecting bar extending circumferentially across a cavity defined in the first flange in which the latching arrangement is arranged, the connecting bar being connected to the latch arm and the support member such that the latch arm and the support member pivot about the connecting bar when transitioning from a disconnected state to the connected state.

6. The reel of claim 5, wherein the first flange includes a plurality of ledges, each of which is configured, in the connected state, to disable the support member of an associated one of the latching arrangements from moving from the connected state to the disconnected state.

7. The reel of claim 6, wherein the support member of each latching arrangement is configured to elastically deform when pivoting from the disconnected state to the connected state so as to pass an associated ledge of the plurality of ledges.

8. The reel of claim 1, wherein the latch arm of each latching arrangement pivots about an axis that is spaced apart from a pivot axis of the associated support member.

9. The reel of claim 8, wherein each support member is configured as a latch lever extending radially from a circumferential wall of a cavity defined in the first flange in which the latching arrangement is arranged.

10. The reel of claim 9, wherein the latch lever of each latching arrangement has a distal end that, in the connected state, engages a pocket defined by the associated latch arm.

11. The reel of claim 10, wherein:

each latching arrangement further comprises at least one stop projecting from the latch arm toward the latch lever and at least partially defining the pocket, and in the connected state, the latch lever abuts the at least one stop such that the at least one stop disables the latch lever from pivoting from the connected state to a disconnected state.

12. The reel of claim 11, wherein the latch lever of each latching arrangement is configured such that, when pivoting from the disconnected state to the connected state, the latch lever deforms so as to pass the at least one stop and move into the pocket.

13. The reel of claim 1, wherein the plurality of latching arrangements are formed integrally with the first flange.

14. The reel of claim 1, further comprising:

a second flange; and a plurality of second latching arrangements configured to, in a second connected state, connect a second end region of the core to the second flange, each respective second latching arrangement of the plurality of second latching arrangements comprising:

a second latch arm having a second latching projection that, in the second connected state, is arranged in an associated second slot of a plurality of second slots defined in the second end region of the core; and a second support member that, in the second connected state, supports the second latch arm on a side of the second latch arm opposite the second latching projection so as to disable the second latching projection from moving out of the associated second slot.

15. The reel of claim 1, wherein the support member applies no force to the side of the latch arm opposite the latching projection in the first position.

16. A method of assembling a reel comprising:

inserting a first end region of a core, which defines a plurality of slots, into a channel of a first flange;

connecting the first end region of the core to the first flange with a plurality of latching arrangements by:

arranging a latching projection of a latch arm of each of the plurality of latching arrangements in an associated slot of the plurality of slots; and supporting the latch arm of each of the plurality of latching arrangements on a side of the latch arm opposite the latching projection by pivotally moving a support member to engage the latch arm so as to disable the latching projection from moving out of the associated slot.

17. The method of claim 16, wherein the supporting of the latch arm occurs prior to the inserting of the first end region of the core and the arranging of the latching projection in the associated slot.

* * * * *